US006394115B1

(12) United States Patent
Tsun

(10) Patent No.: US 6,394,115 B1
(45) Date of Patent: May 28, 2002

(54) INTERMEDIATE RIB FOR COLLAPSIBLE UMBRELLA

(76) Inventor: Zong Wu Tsun, P.O. Box 82-144, Taipei (TW)

( * ) Notice: Subject to any disclaimer, the term of this patent is extended or adjusted under 35 U.S.C. 154(b) by 0 days.

(21) Appl. No.: 09/678,843

(22) Filed: Oct. 4, 2000

(51) Int. Cl.[7] ..... A45B 19/10
(52) U.S. Cl. ..... 135/25.3; 135/31
(58) Field of Search ..... 135/25.3, 25.31, 135/25.32, 26, 31

(56) References Cited

U.S. PATENT DOCUMENTS 2,616,439 A * 11/1952 Thompson ..... 135/25.31
4,658,844 A * 4/1987 Ping ..... 135/25.3
4,766,917 A * 8/1988 Yang ..... 135/25.3
4,815,489 A * 3/1989 Yang ..... 135/25.3
5,564,449 A * 10/1996 Lin et al. ..... 135/25.3 X
6,158,452 A * 12/2000 You ..... 135/25.31 X
6,202,661 B1 * 3/2001 Okuda ..... 135/31 X
6,230,725 B1 * 5/2001 Ko ..... 135/31

* cited by examiner

*Primary Examiner*—Laura A. Callo
(74) *Attorney, Agent, or Firm*—A & J

(57) ABSTRACT

An intermediate rib for collapsible umbrella is provided. The collapsible umbrella includes multiple sets of rib arrangements each of which includes an intermediate rib and an intermediate tie in addition to many other ribs and ties. The intermediate rib and tie are associated with each other by a collar put around them. The intermediate rib includes an U-shaped inner part that is adapted to support and pivotally connect to other appropriate ribs, and a round outer part that is sufficiently flexible to elastically bend in response to a wind pressure without becoming broken. The outer part of the intermediate rib bends naturally under a tension of the cover of the umbrella when the latter is stretched, giving the stretched umbrella a smooth and graceful appearance. The intermediate tie has an U-shaped bend near a middle portion thereof with two sides thereof engaged into two axial guide slots provided at two ends of the collar, so that the intermediate tie is guided by the collar to slide along the intermediate rib without shifting sideward when the umbrella is stretched or collapsed.

2 Claims, 7 Drawing Sheets

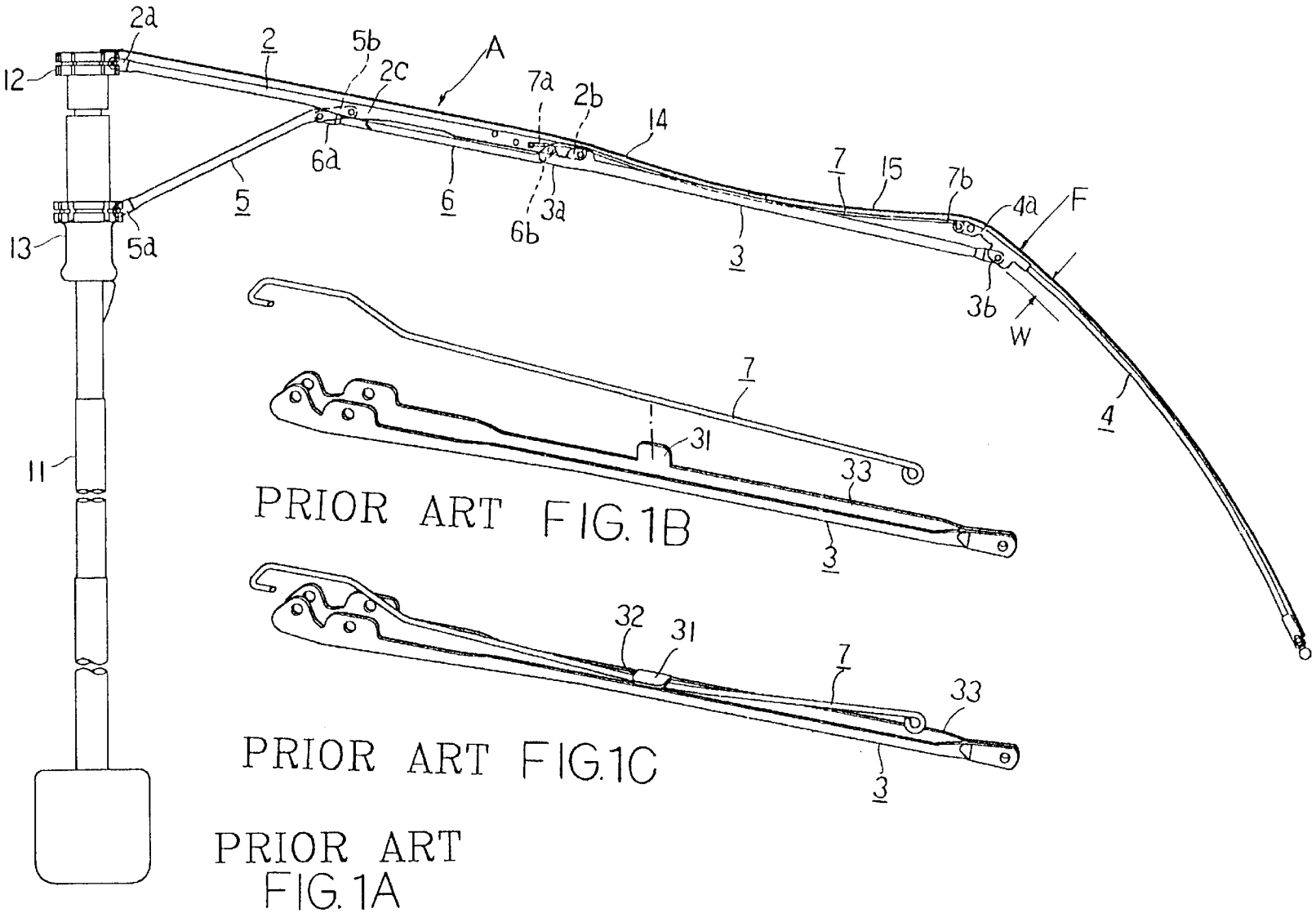
PRIOR ART FIG.1A
PRIOR ART FIG.1B
PRIOR ART FIG.1C

INTERMEDIATE RIB FOR COLLAPSIBLE UMBRELLA

BACKGROUND OF THE INVENTION

The present invention relates to an intermediate rib for collapsible umbrella, and more particularly to an umbrella intermediate rib that is not easily subject to bending and deformation, so that the stretched umbrella has a graceful appearance and the collapsed umbrella has even reduced volume.

As shown in FIG. 1A, a common collapsible umbrella mainly includes a telescopic shaft 11 consisting of multiple segments, a hub 12 mounted to a top of the shaft 11, a runner 13 slidably put around the shaft 11 to move up, and down along the shaft 11, multiple sets of rib arrangements (A), and a cover 14 connected to and covering top of the rib arrangements (A).

Each set of the rib arrangement (A) includes an inner rib 2, an intermediate rib 3, an outer rib 4, a stretcher 5, an inner tie 6, and an intermediate tie 7 that are connected to one another in a predetermined manner. The inner rib 2 is pivotally connected at an inner end 2*a* to the hub 12 and at an outer end 2*b* to the intermediate rib 3 close to, an inner end 3*a* thereof, the stretcher 5 is pivotally connected at an inner end 5*a* to the runner 13 and at an outer end 5*b* to the inner rib 2 close to a middle 2*c* thereof, the inner tie 6 is pivotally connected at an inner end 6*a* to the stretcher 5 close to the outer end 5*b* thereof and at an outer end 6*b* to the inner end 3*a* of the intermediate rib 3, the intermediate rib 3 is pivotally connected at the inner end 3*a* to the outer end 6*b* of the inner tie 6 and at an outer end 3*b* to the outer rib 4 close to an inner end 4*a* thereof, and the intermediate tie 7 is pivotally connected at an inner end 7*a* to the inner rib 2 close to the outer end 2*b* the of and at an outer end 7*b* to the inner end 4*a* of the outer rib 4. As can be seen from FIGS. 1B and 1C, the intermediate rib 3 is an open-topped U-shaped member and is provided near a middle point of one side wall thereof with a lug 31 that is bent to flatly lie across the open top of the U-shaped rib 3, so that a passage 32 is provided between the bent lug 31 and the U-shaped rib 3. The intermediate tie 7 is adapted to extend through the passage 32 in order to slide in the U-shaped intermediate rib 3 below the bent lug 31 when the umbrella is stretched or collapsed.

In each set of the rib arrangement, the inner rib 2, the stretcher 5, and the intermediate rib 3 are mainly provided to serve as supports and therefore usually have an U-shaped cross section. The intermediate tie 7 and the outer rib 4 need to elastically bend when the umbrella is stretched or collapsed and when the umbrella is subject to a strong wind pressure and therefore usually have a round cross section and are flexible. As to the inner tie 6, it may be either an U-shaped or a round member.

In brief, the conventional intermediate rib 3 for collapsible umbrella is provided with an U-shaped cross section to achieve the projected supporting effect. Such U-shaped intermediate rib 3 has, however, the following disadvantages:

1. When a user stretches the umbrella while walks or while there is wind blowing against the stretched umbrella, the cover of the umbrella, particularly an outer periphery of the cover, is subject to a downward wind pressure (F). At this point, the flexible outer rib 4 having a round cross section would naturally elastically bend in a direction the same as that of the wind to avoid deformation or breaking thereof. The wind pressure (F) also applies on the outer end 3*b* of the intermediate rib 3. As mentioned before, the entire intermediate rib 3 has an U-shaped cross section and is therefore a rigid instead of a flexible member. When the cover 14 of the stretched umbrella is subject to a high wind pressure (F), the rigid intermediate rib 3 would fail to elastically bend in response to the wind pressure applied on it and tends to deform and become damaged near the inner end 3*a* thereof.
2. The conventional U-shaped rigid intermediate rib 3 is not adapted to naturally and elastically bend under the tension of the cover 14. And, since the outer end 3*b* of the intermediate rib 3 is pivotally connected to the outer rib 4 close to the inner end 4*a* thereof, there are clearances existing between the intermediate rib 3 and the cover 14. Areas of the cover 14 above such clearances tend to form undesirable depressions 15 when the umbrella is stretched.
3. The U-shaped intermediate rib 3 has two side-walls 33 that necessitate a large space W for the outer end 3*b* of the intermediate rib 3 to pivotally connect to the outer rib 4. The side walls 33 of the intermediate rib 3 also make the collapsed umbrella to occupy a large space.

Another problem with the conventional intermediate rib 3 is that the intermediate tie 7 extended through the passage 32 below the bent lug 31 of the intermediate rib 3 is slightly bent and deformed at a point below the lug 31. Therefore, the intermediate tie 7 undesirably frictionally contacts with two ends of the bent lug 31 when it moves relative to the intermediate rib 3 at the time the umbrella is stretched or collapsed, preventing the umbrella from stretching or collapsing smoothly.

SUMMARY OF THE INVENTION

It is therefore a primary object of the present invention to provide-an improved intermediate rib for collapsible umbrella, wherein the intermediate rib includes an U-shaped inner part that is adapted to support and pivotally connect to other appropriate ribs, and a round outer part that is sufficiently flexible to elastically bend in response to a wind pressure without becoming broken. The round outer part of the intermediate rib bends naturally under a tension of the cover of the umbrella when the latter is stretched, giving the stretched umbrella a smooth and graceful appearance. The round outer part of the intermediate rib, being without U-shaped walls, also enables the pivotal connection of the intermediate rib to the outer rib within a reduced space and to further reduce the collapsed volume of the umbrella.

Another object of the present invention is to provide an improved intermediate rib for collapsible umbrella, wherein the intermediate rib is associated with the intermediate tie with a collar. The intermediate tie has an U-shaped bend near a middle portion thereof with two sides of the U-shaped bend engaged into two axial guide slots provided at two ends of the collar, so that the intermediate tie is guided by the collar to slide along the intermediate rib without shifting sideward when the umbrella is stretched or collapsed.

BRIEF DESCRIPTION OF THE-DRAWINGS

The structure and the technical means adopted by the present invention to achieve the above and other objects can be best understood by referring to the following detailed description of the preferred embodiments and the accompanying drawings, wherein FIG. 1A shows a rib arrangement for a conventional collapsible umbrella;

FIG. 1B is an exploded perspective showing the relation between an intermediate rib and an intermediate tie of the rib arrangement shown in FIG. 1A;

FIG. 1C is an assembled perspective of the intermediate rib and the intermediate tie of FIG. 1B;

DETAILED DESCRIPTION OF THE PREFERRED EMBODIMENTS

Figures 2A, 2B:
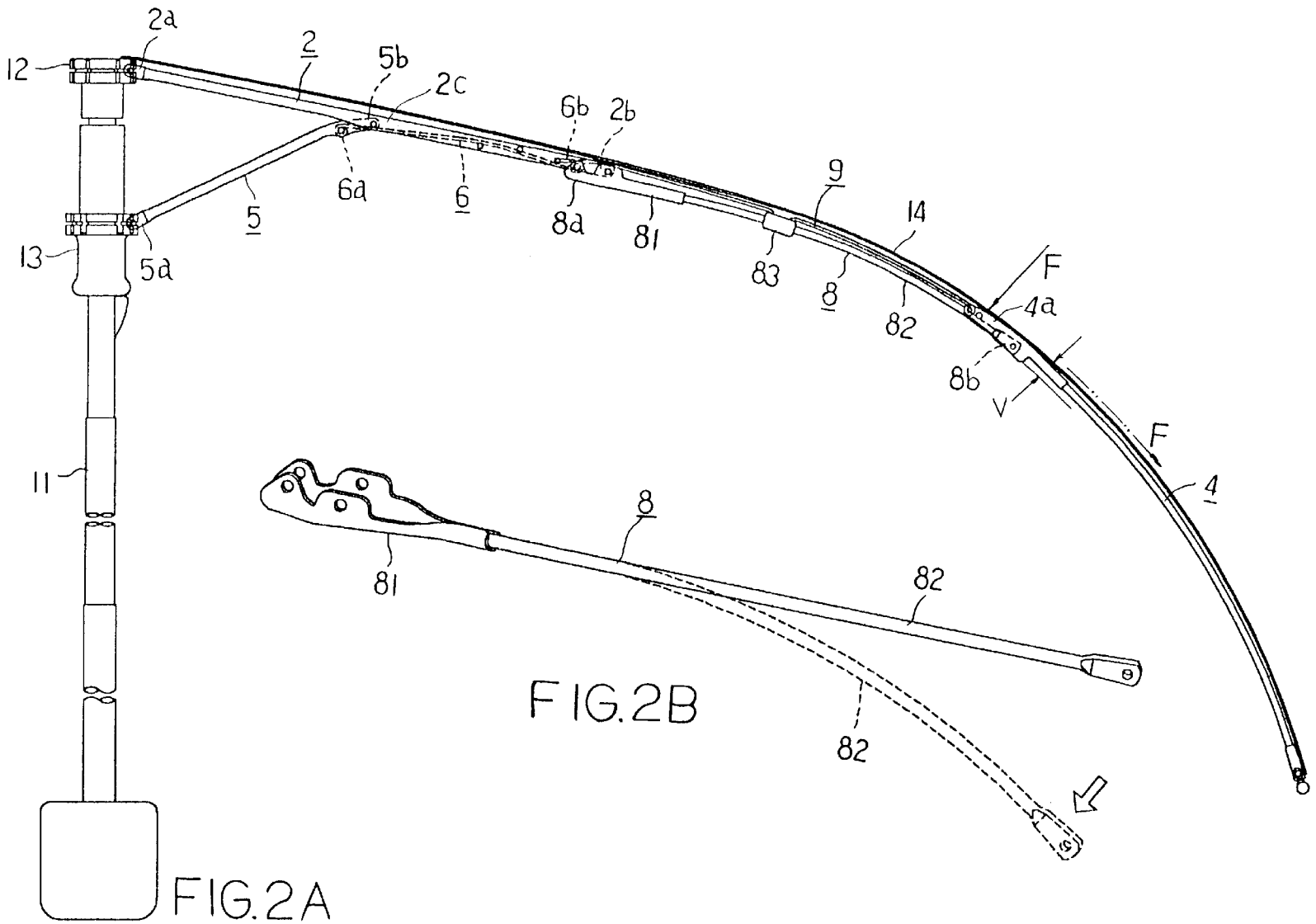
FIG. 2A is a rib arrangement for a collapsible umbrella according to an embodiment of the present invention.
FIG. 2B is a perspective of an intermediate rib included in the rib arrangement of FIG. 2A and shows how the intermediate rib bends when the same is subject to a tension of a cover of the umbrella or to a wind pressure.
Figure 3A:
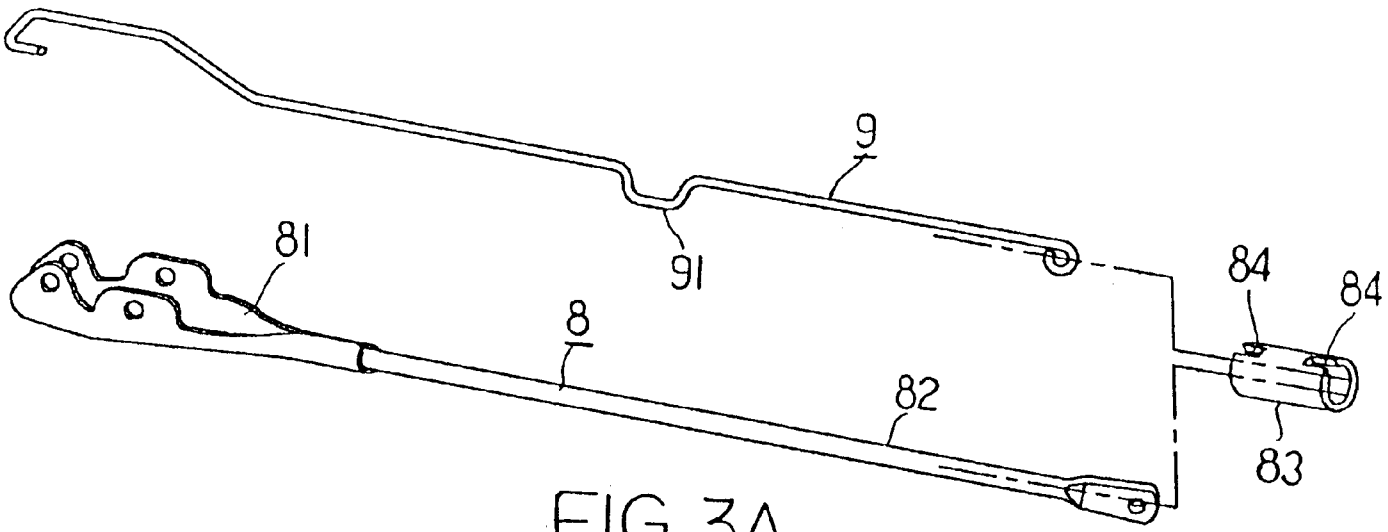
FIG. 3A is an unexploded perspective showing the relation between the intermediate rib and an intermediate tie included in the rib arrangement of FIG. 2A.
Figure 3B:
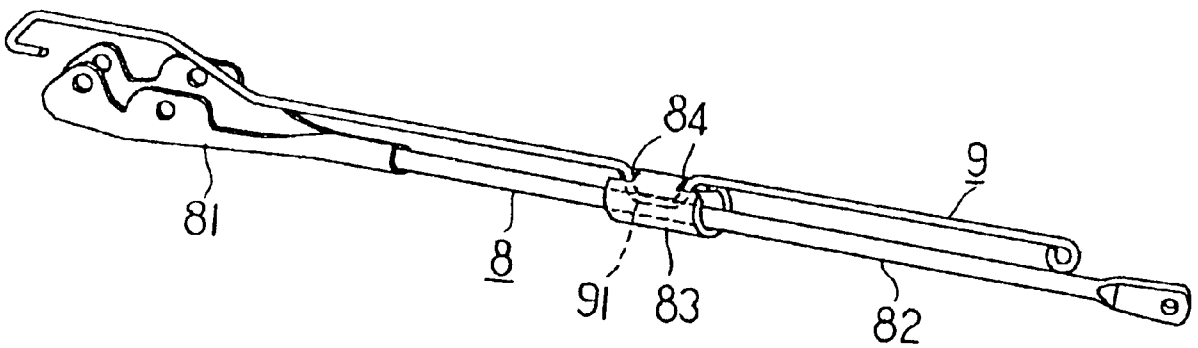
FIG. 3B is an assembled perspective of FIG. 3A.
Figure 4:
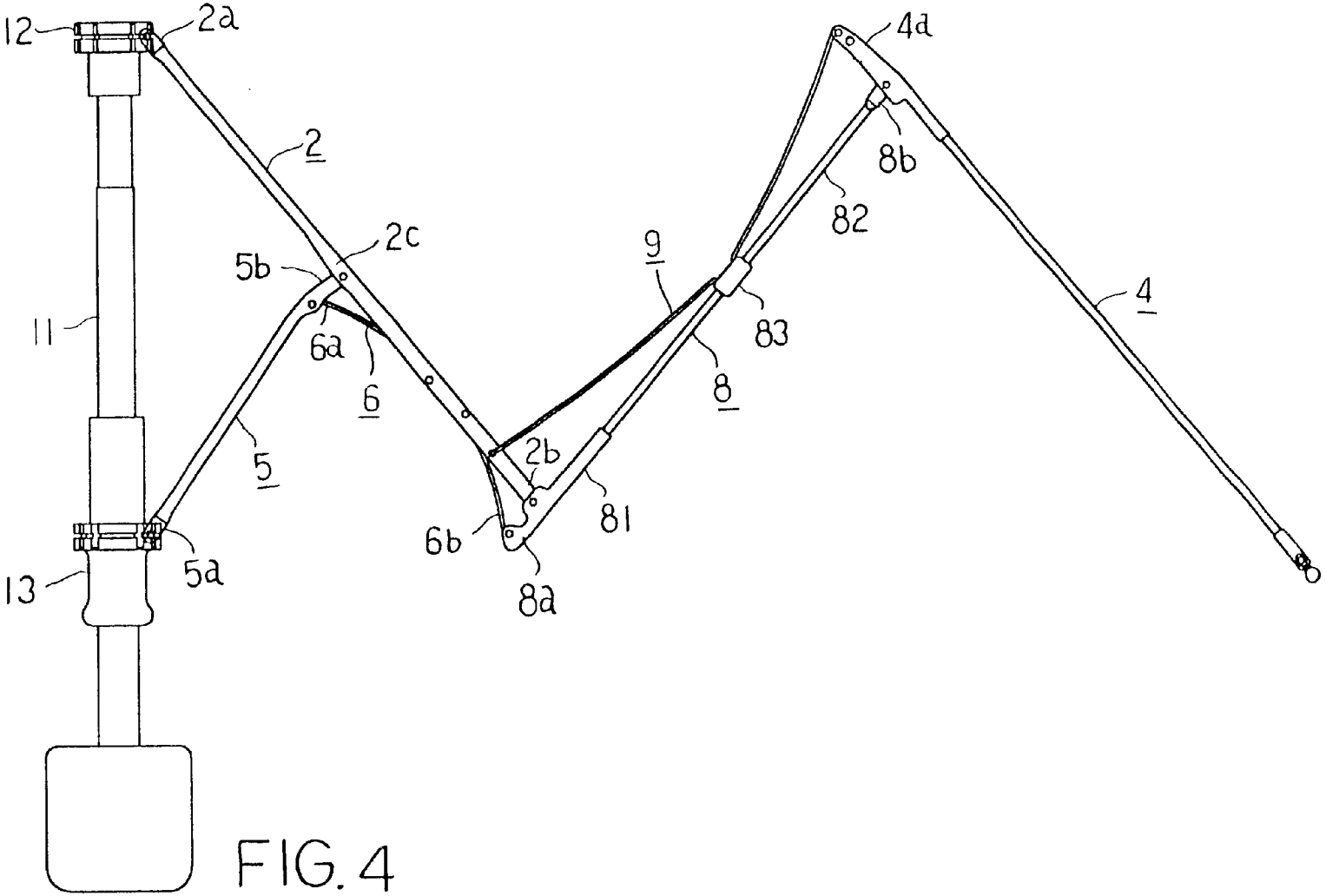
FIG. 4 shows the rib arrangement of FIG. 2A in a half collapsed state.
Figure 5:
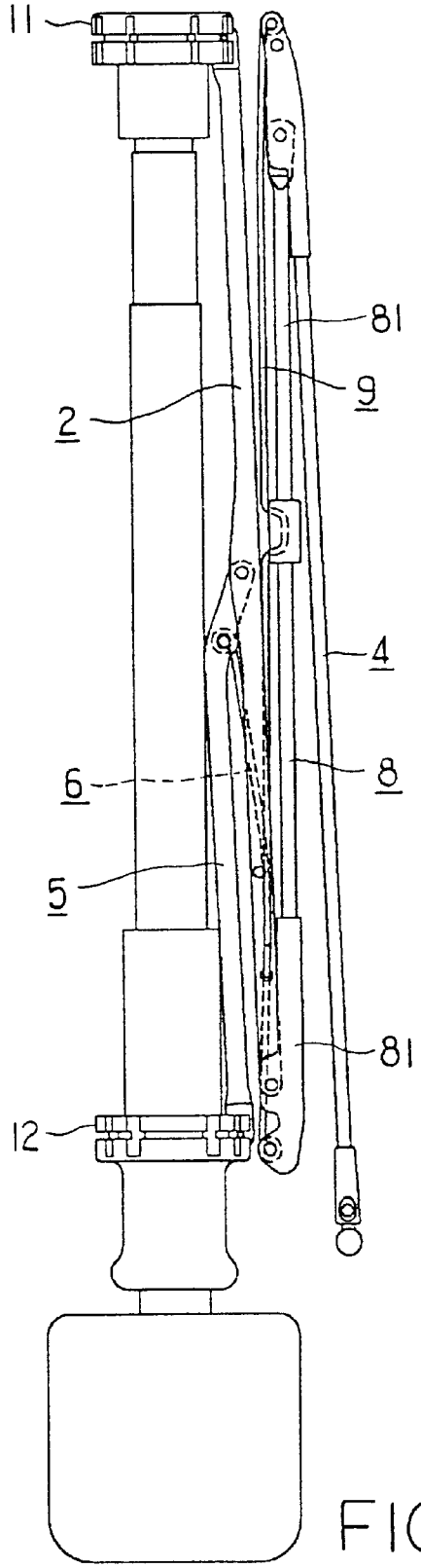
FIG. 5 shows the rib arrangement of FIG. 2A in a fully collapsed state.

The present invention relates to an umbrella rib arrangement that is generally similar to the conventional ones except that an intermediate rib 8 thereof includes two differently structured parts and that an intermediate tie 9 of the present invention is slidably associated with the intermediate rib 8 with a collar 83.

Please refer to FIGS. 2 to 5 in which an intermediate rib for a collapsible umbrella according to a first embodiment of the present invention is shown. The intermediate rib 8 of the present invention is a member consisting of two differently structured parts. More particularly, the intermediate rib 8 includes an inner part 81 having an U-shaped cross section and an outer part 82 having a round cross section and therefore being flexible. The intermediate tie 9 is slidably associated with the intermediate rib 8 with a collar 83. As can be seen from FIGS. 3A and 3B, the intermediate tie 9 has an U-shaped bend 91 near a middle thereof, and the collar 83 is cut to provide two axial guide slots 84 at two ends thereof. The intermediate tie 9 is adapted to extend through the collar 83 with the U-shaped bend 91 located below and engaged with the two guide slots 84. The round outer part 82 of the intermediate rib 8 is also adapted to extend through the collar 83. Whereby when the umbrella is stretched or collapsed and the intermediate tie 9 is brought to change its position relative to the intermediate rib 8, the collar 83 engaged with the bend 91 of the intermediate tie 9 guides the intermediate tie 9 to smoothly slide along the round outer part 82 of the intermediate rib 8.

In this first embodiment, the U-shaped inner part 81 of the intermediate rib 8 well functions as a support for the umbrella while an inner end 8a thereof is adapted to pivotally connect to the inner rib 2 and the inner tie 6, and the round outer part 82 of the intermediate rib 8 is sufficiently flexible to bear a wind pressure F and naturally downward bend along with the outer rib 4 and the intermediate tie 9 under the wind pressure F. The intermediate rib 8 of the present invention therefore allows the cover 14 of the fully stretched umbrella to show a smoothly downward curved shape that is helpful in guiding air to flow outward and downward and thereby reduces a direct effect of the wind pressure on the cover 14 of the umbrella. Moreover, the flexibility of the round outer part 82 of the intermediate rib 8 allows it to elastically bend in response to the wind pressure and can therefore reduce a reaction force of the inner end of the intermediate rib 8 against the wind pressure F to prevent the intermediate rib 8 from easily bending and/or deforming.

As can be seen from FIG. 2A, since the round outer part 82 of the intermediate rib 8 is adapted to naturally bend downward in response to the tension of the cover 14 and the wind pressure F, the round outer part 82 of the intermediate rib 8 and the intermediate tie 9 could always fitly contact with the cover 14 to provide the stretched umbrella a smoothly and gracefully curved appearance that also advantageously guides airflow to smoothly pass the cover 14 of the umbrella along the curved shape thereof.

Unlike the conventional intermediate rib 3 that has an U-shaped cross section and therefore has two spaced side walls, the round outer part 82 of the intermediate rib 8 of the present invention does not have any side wall and needs only a smaller space V for an outer end 8*b* of the round outer part 82 to pivotally connect to the outer rib 4, compared with the space W needed in the conventional umbrella rib arrangement.

The guide slots 84 provided at two ends of the collar 83 engage with two sides of the U-shaped bend 91 of the intermediate tie 9 and are therefore adapted to control the intermediate tie 9 for the same to interact with the intermediate rib 8 and to smoothly and stably slide along a direction defined by an axis of the intermediate rib 8 without shifting sideward relative to the latter when the umbrella is stretched or collapsed.

Figures 6A, 6B:
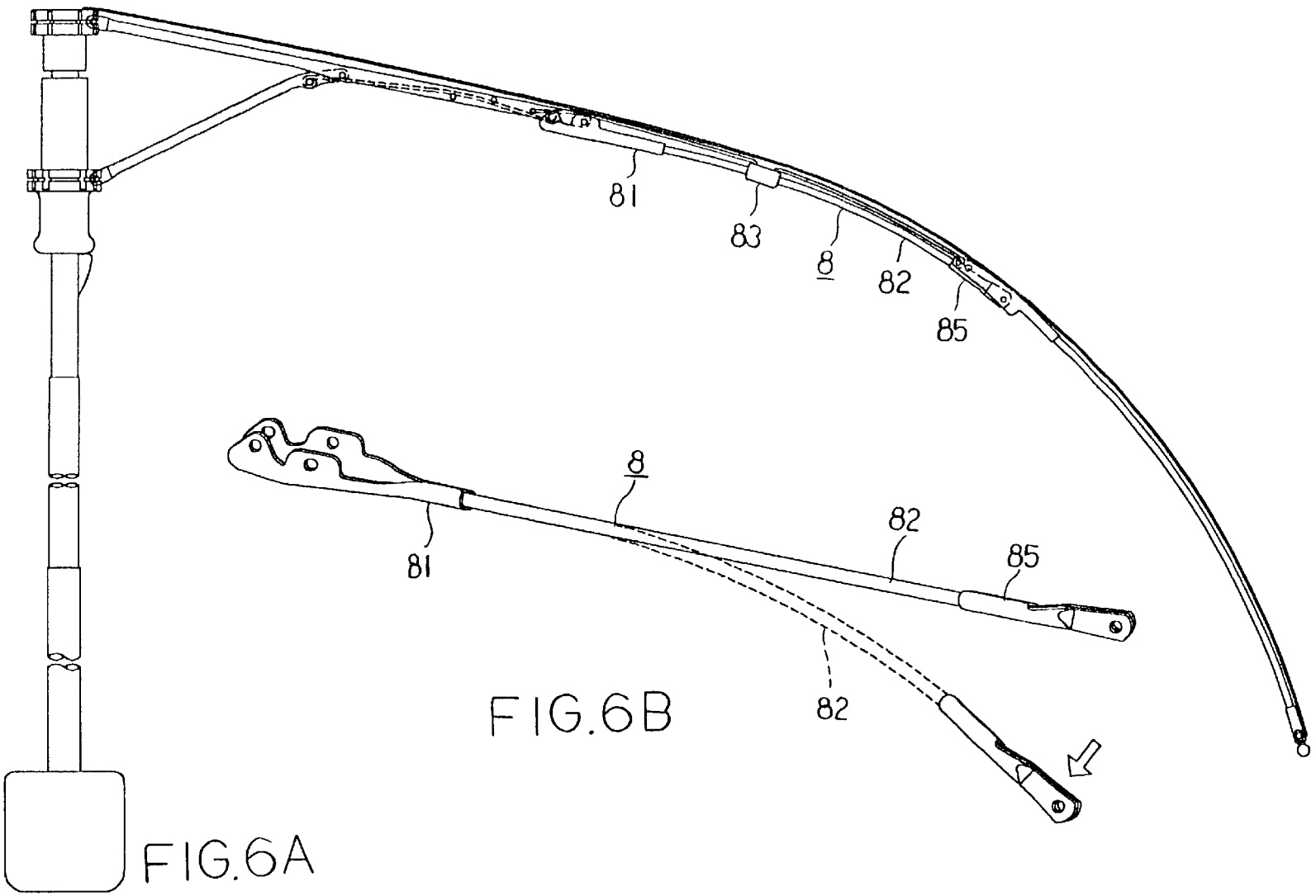
FIG. 6A is a rib arrangement for a collapsible umbrella according to another embodiment of the present invention.
FIG. 6B is a perspective of an intermediate rib included in the rib arrangement of FIG. 6A and shows how the intermediate rib bends when the same is subject to a tension of a cover of the umbrella or to a wind pressure.
Figure 7A:
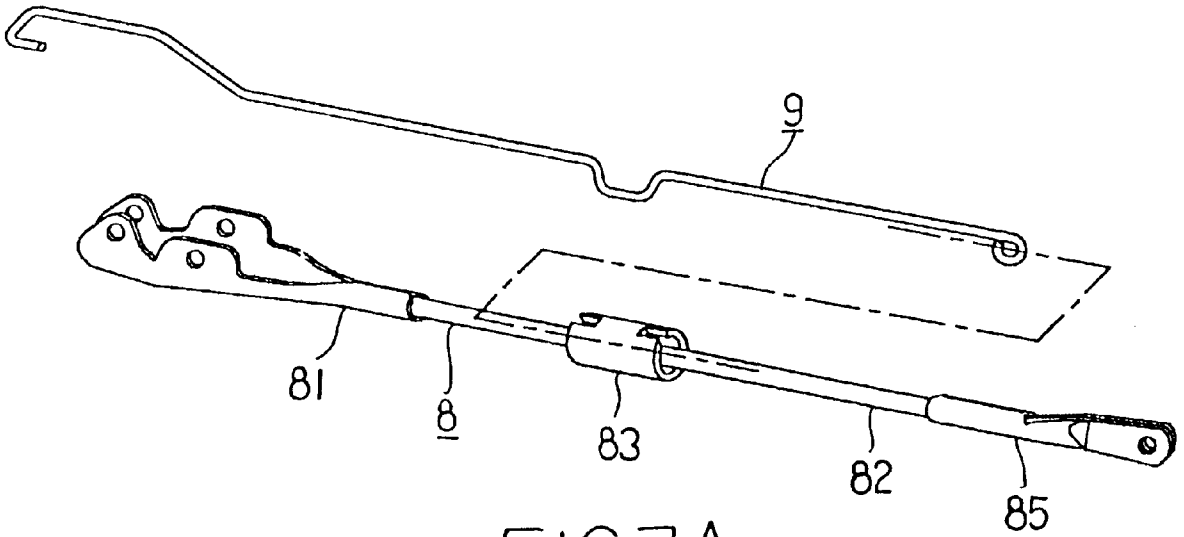
FIG. 7A is an unexploded perspective showing the relation between the intermediate rib and an intermediate tie included in the rib arrangement of FIG. 6A.
Figure 7B:
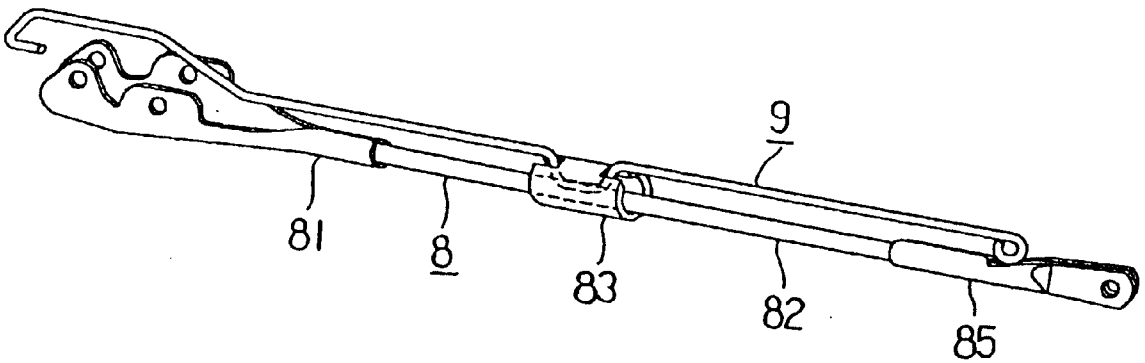
FIG. 7B is an assembled perspective of FIG. 7A.

In FIGS. 6A and 6B, there is shown an intermediate rib for collapsible umbrella according to a second embodiment of the present invention; and FIGS. 7A and 7B are exploded and assembled perspective views, respectively, of the intermediate rib 8 and the intermediate tie 9 thereof. In this second embodiment, the round outer part 82 of the intermediate rib 8 is made of a non-metal material, such as carbon-fiber material. In this case, a pivotal coupler 85 is mounted at the outer end of the round outer part 82 of the intermediate rib 8 to pivotally connect the same to the outer rib 4. The pivot coupler 85 is a separate metal component being tightly clamped onto the outer end of the round outer part 82 of the intermediate rib 8. Alternatively, the pivot coupler 85 maybe made of plastic material by way of injection molding and then be fixedly mounted to the outer end of the round outer part 82 of the intermediate rib 8.

What is claimed is:

1. In a collapsible umbrella having multiple sets of rib arrangements each of which includes an inner rib, an intermediate rib, an outer rib, a stretcher, an inner tie, and an intermediate tie connected to one another, wherein said inner rib is pivotally connected at an inner end to a hub provided at a top of a shaft of the umbrella and at an outer end to the said intermediate rib close to the inner end thereof, said stretcher being pivotally connected at an inner end to a runner movable along the shaft of the umbrella and at an outer end to said inner rib close to a middle point thereof, said inner tie being pivotally connected at an inner end to said stretcher close to the outer end thereof and at outer end to the inner end of said intermediate rib thereof, said intermediate rib being pivotally connected at the inner end to the outer end of said inner tie and at an outer end to said outer rib close to an inner end thereof, said intermediate tie being pivotally connected at an inner end to said inner rib close to the outer end thereof and at an outer end to an inner end of said outer rib, said intermediate rib comprising two differently structured parts, namely, an inner part having an U-shaped cross section and an outer part having a round cross section; said round outer part of said intermediate rib being associated with said inter-mediate tie by means of a collar put around them, said collar being provided at two ends with two axial guide slots, and said intermediate tie being provided near a middle portion with a U-shaped bend, two sides of which being engaged into said two guide slots of said collar, such that said intermediate tie is always guided by said collar to slide along said intermediate rib without shifting sideward when said umbrella is stretched or collapsed to cause said intermediate tie move relative to said intermediate rib.

2. The intermediate rib for a collapsible umbrella as claimed in claim 1, wherein said round outer part of said intermediate rib has a pivot coupler mounted to an outer end thereof.

* * * * *

UNITED STATES PATENT AND TRADEMARK OFFICE

CERTIFICATE OF CORRECTION

PATENT NO. : 6,394,115 B1
DATED : May 28, 2002
INVENTOR(S) : Tsun-Zong Wu

It is certified that error appears in the above-identified patent and that said Letters Patent is hereby corrected as shown below:

Title page,
Item [76], should read -- Inventor: Tsun-Zong Wu --

Signed and Sealed this

Twenty-third Day of July, 2002

*Attest:*

*Attesting Officer*

JAMES E. ROGAN
*Director of the United States Patent and Trademark Office*